US012241681B1

(12) United States Patent
Bodenburg et al.

(10) Patent No.: US 12,241,681 B1
(45) Date of Patent: Mar. 4, 2025

(54) COOLING SYSTEM PREFAILURE DETECTION SYSTEM AND METHOD

(71) Applicant: ONEEVENT TECHNOLOGIES INC., Mount Horeb, WI (US)

(72) Inventors: Brett Bodenburg, Mt. Horeb, WI (US); Kurt Joseph Wedig, Mount Horeb, WI (US); Daniel Ralph Parent, Mount Horeb, WI (US)

(73) Assignee: OneEvent Technologies, Inc., Mount Horeb, WI (US)

( * ) Notice: Subject to any disclaimer, the term of this patent is extended or adjusted under 35 U.S.C. 154(b) by 541 days.

(21) Appl. No.: 17/472,815

(22) Filed: Sep. 13, 2021

Related U.S. Application Data

(60) Provisional application No. 63/077,014, filed on Sep. 11, 2020.

(51) Int. Cl.

| | |
|---|---|
| ***F24F 11/38*** | (2018.01) |
| ***F25B 49/00*** | (2006.01) |
| ***F25D 29/00*** | (2006.01) |

(52) U.S. Cl.
CPC ..... *F25D 29/006* (2013.01); *F24F 11/38* (2018.01); *F25B 49/005* (2013.01); *F25B 2700/151* (2013.01); *F25B 2700/193* (2013.01); *F25D 2600/06* (2013.01); *F25D 2700/02* (2013.01); *F25D 2700/12* (2013.01)

(58) Field of Classification Search
CPC ..... F24F 11/38
See application file for complete search history.

(56) References Cited

U.S. PATENT DOCUMENTS

2018/0128713 A1* 5/2018 Kriss ..... G01N 29/14

* cited by examiner

*Primary Examiner* — Jonathan Bradford
(74) *Attorney, Agent, or Firm* — Kenneth A. Smith

(57) ABSTRACT

A system for and method of monitoring cooling system parameters where the system identifies characteristic behaviors of the cooling system and establishes limits that identify when a parameter or parameters indicate that the cooling system is experiencing a failure or is predicted to experience a failure in the future. The system includes a processor, memory and instruction that when executed by the processor, perform steps to detect actual failures or predict future failures of the cooling system being monitored.

23 Claims, 7 Drawing Sheets

COOLING SYSTEM PREFAILURE DETECTION SYSTEM AND METHOD

CROSS REFERENCE TO RELATED APPLICATIONS

The present application claims priority to provisional U.S. Patent Application No. 63/077,014, filed on Nov. 9, 2020.

TECHNICAL FIELD

The present invention relates generally to a system for and method of monitoring for and predicting the failure of a cooling system resulting from the failure of one or more components.

BACKGROUND

Cooling systems are used to provide temperature control in a variety of different applications. Some examples include refrigerators, freezers, and indoor climate control. A typical cooling system employs a compressor that compresses a gas, a first heat exchanger that removes heat from the compressed gas, an expansion device that allows the compressed gas to expand into a chamber which is generally a second heat exchanger. The second heat exchanger extracts heat from its surroundings, providing a refrigeration function. While the example applications generally involve heat exchangers designed to interface with air, certain implementations can be configured to transfer heat to or from liquids. Additionally, the system described can be used to heat rather than cool. Many cooling systems using the components and methods described simply cycle the compressor on and off. During the on-time of the compressor, the temperature of the gas in the second heat exchanger rapidly cools the heat exchanger to a certain temperature level. During the off-time, the heat exchanger warms to a level that approaches the temperature of the environment in which is it located. As a result, the environment in which the heat exchanger is located also exhibits a cyclic temperature variation.

When cooling systems are used to maintain the environmental conditions for food, medications, or other perishable items, the failure of the cooling system can result in a significant financial loss or a danger to persons in need of the medications. As with many mechanical systems, compressors and valves wear and tubing leaks, resulting in the eventual failure of the cooling system. A system and method of detecting an impending failure is needed to detect failure sufficiently in advance of the actual failure such that action may be taken to prevent loss of, or damage to, food, medications, or perishable items.

SUMMARY

In exemplary embodiments, a temperature associated with a first heat exchanger is measured over a period of time and variations of that temperature are compared to a baseline temperature variation. The characteristics of the measured temperature are evaluated for indication of impending failures where the characteristics may comprise such measurements as maximum temperatures, minimum temperatures, the length of time that passes between the maximum and minimum temperatures, the frequency of the maximum or minimum temperatures, the rate of change of temperature, or the variation of rate of change as the temperature either increases or decreases over time.

In another exemplary embodiment, a pressure measured in a Cooling system over a period of time and a variation of that pressure is compared to a baseline pressure. The characteristics of the measured pressure are evaluated for indication of impending failures where the characteristics may comprise such measurements as maximum pressure, minimum pressure, the length of time that passes between the maximum and minimum pressures, the frequency of the maximum or minimum pressures, the rate of change of pressure, or the variation of rate of change as the pressure either increases or decreases over time.

In another exemplary embodiment, a compressor current draw measured in a Cooling system over a period of time and a variation of that current draw is compared to a baseline current draw. The characteristics of the measured current draw are evaluated for indication of impending failures where the characteristics may comprise such measurements as maximum current, minimum current, the length of time that passes between the maximum and minimum currents, the frequency of the maximum or minimum currents, the rate of change of current, or the variation of rate of change as the current either increases or decreases over time.

The above summary is not intended to describe each illustrated embodiment or every implementation of the invention. Rather, the embodiments are chosen and described so that other skilled in the art can appreciate and understand the principles and practices of the invention. The figures and the detailed description that follow more particularly exemplify these embodiments.

BRIEF DESCRIPTION OF THE DRAWINGS

These and other features and advantages of the present invention will become better understood with regard to the following description and accompanying drawings in which.

Figure 1:
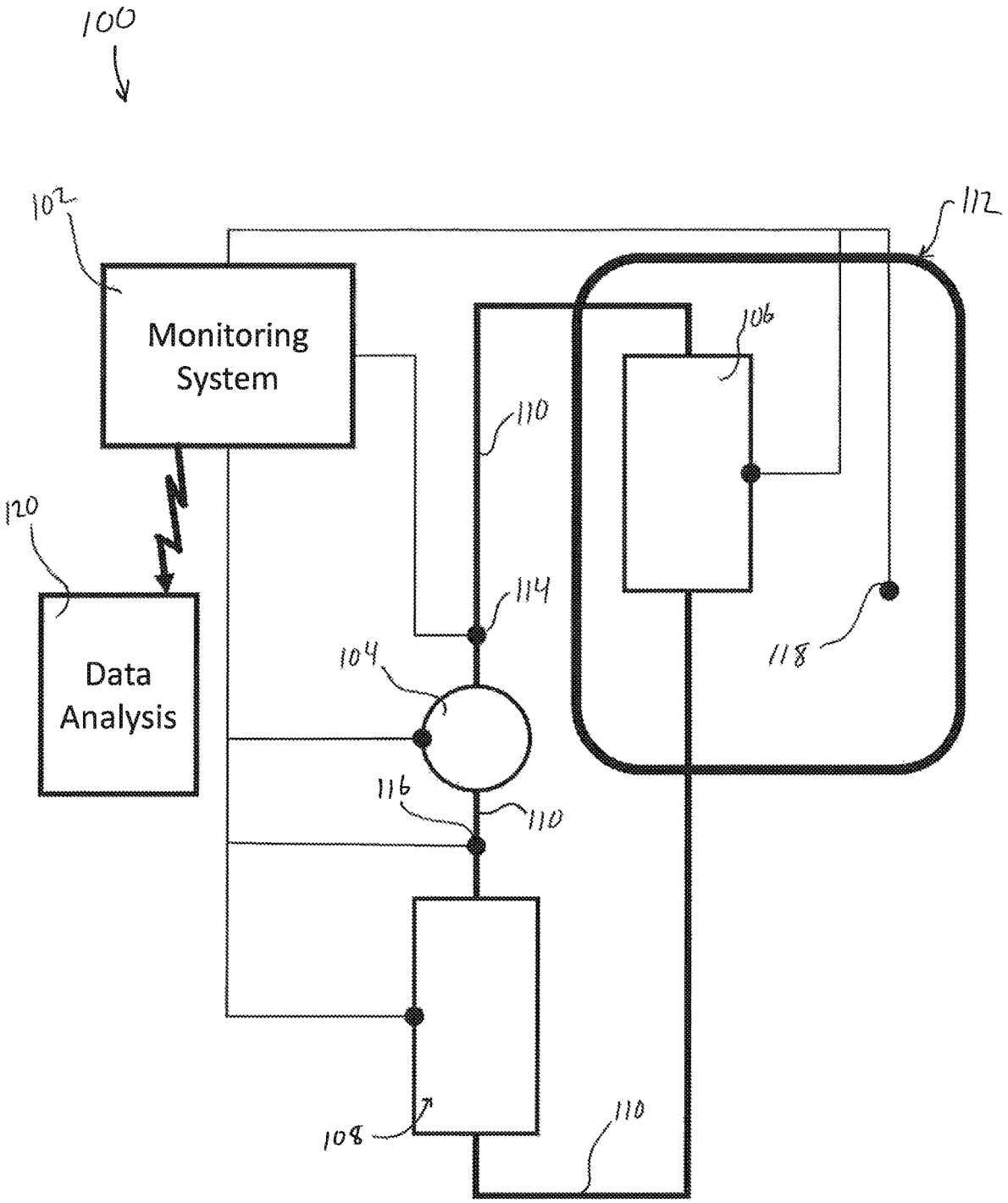
FIG. 1 illustrates a block diagram of a cooling system including a monitoring system according to an exemplary embodiment.

While various embodiments are amenable to various modifications and alternative forms, specifics thereof have been shown by way of example in the drawings and will be described in detail. The drawings thus provide illustration and a further understanding of the various aspects and implementations, and are incorporated in and constitute a part of this specification. It should be understood, however, that the intention is not to limit the claimed inventions to the particular embodiments described. On the contrary, the intention is to cover all modifications, equivalents, and alternatives falling within the spirit and scope of the subject matter as defined by the claims. These and other aspects and implementations are discussed in detail below. The foregoing information and the following detailed description include illustrative examples of various aspects and implementations, and provide an overview or framework for understanding the nature and character of the claimed aspects and implementations.

DETAILED DESCRIPTION

As used herein, the term Cooler refers to a container for keeping items such as, without limitation, food, drink, or medications, at a regulated temperature. As used herein, the term cooler can be used interchangeably with refrigerator, freezer, pharmacy cooler, pharmacy freezer, or other devices that regulate temperature.

As used herein, the term Cooling System refers to a system that regulates the temperature at which items may be stored.

As used herein, the term User refers to a person or organization that stores items in a cooler.

As used herein, the term Learning Cooler refers to a cooler that has parameters (i.e., Upper Time Limit and Lower Time Limit) that may change over time, based on past cooler characteristics.

As used herein, the term Non-Learning Cooler refers to a cooler that has parameters (i.e., Upper Time Limit and Lower Time Limit) that are manually set.

As used herein, the term Upper Temperature Limit refers to a desired maximum temperature a cooler may exhibit for a period of time.

As used herein, the term Upper Time Limit refers to the duration a cooler's temperature may remain above its Upper Temperature Limit. Once the duration has been exceeded, a notification may be sent to a user.

As used herein, the term Lower Temperature Limit refers to a desired minimum temperature exhibited by a cooler for a period of time.

As used herein, the term Lower Time Limit refers to the duration a cooler's temperature may remain below its Lower Temperature Limit. Once the duration has been exceeded, a notification may be sent to a user.

As used herein, the term Notification Interval refers to the unit of time to send reminder notifications of a persisting issue of a cooler after a first notification has been sent.

As used herein, the term Notification Count refers to the total number of notifications a user could receive for a single condition detected in a cooler.

Figure 2:
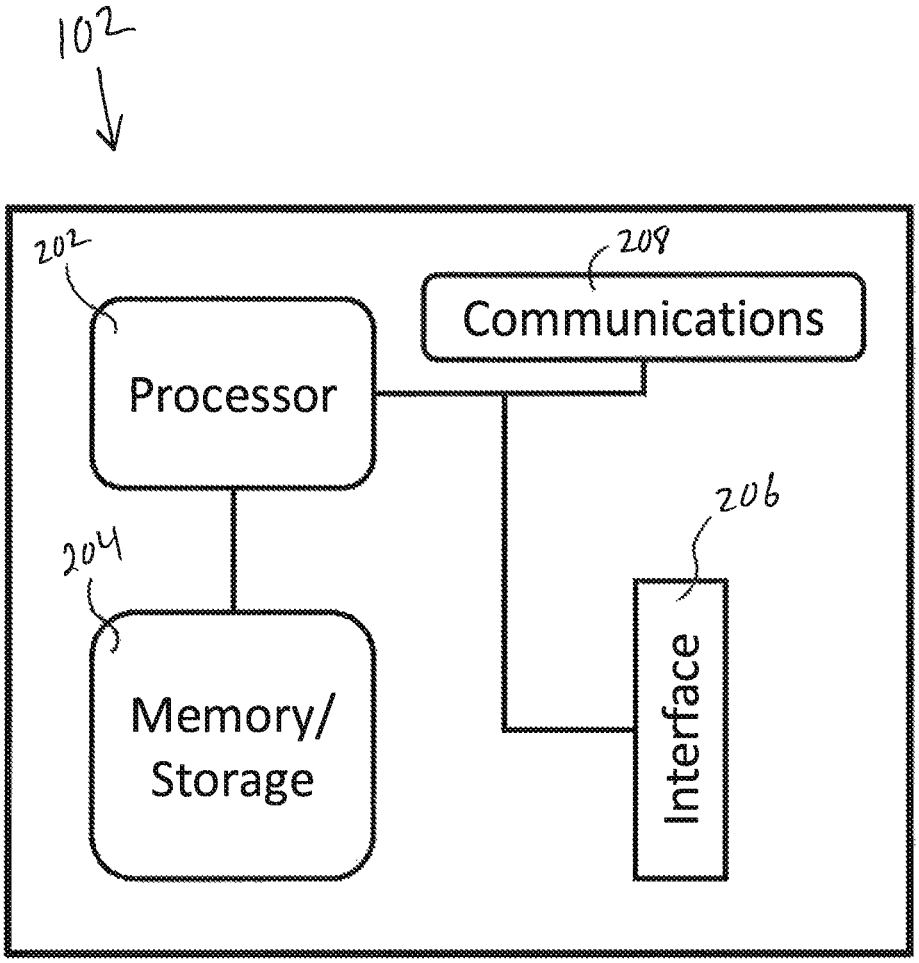
FIG. 2 illustrates a block diagram of a monitoring system according to an exemplary embodiment.

FIG. 1 illustrates an exemplary cooling system 100 which also comprises a monitoring system 102 that monitors and analyzes cooling system behavior according to an exemplary embodiment. As illustrated, the cooling system includes a compressor 104, a first heat exchanger 106, a second heat exchanger 108, coolant lines 110 that circulate a coolant, and an enclosure 112, inside which the cooling system maintains a desired environmental condition. As illustrated in FIG. 2, an exemplary monitoring system 102 comprises a processor 202, and memory 204 which may also function as storage for data collected by the monitoring system 102. In an exemplary monitoring system 102, the monitoring system also comprises an interface 206 which receives and transmits signals to and from various sensors located at various cooling system components. Signals may be received from the sensors by wired or wireless methods depending upon application. In addition, the monitoring system may also include a communications portion 208 which in certain exemplary embodiments, communicates to other monitoring systems, data collection systems, or to a user. In some exemplary embodiments, the monitoring system may be integrated with sensors which collect data from one or more cooling system components.

Referring again to FIG. 1, in an exemplary embodiment, the monitoring system 102 receives data from the compressor 104, the first heat exchanger 106, the second heat exchanger 108, locations (114 and 116) at coolant lines 110, inside the enclosure 112, or any combination of these locations. In certain exemplary embodiments, the monitoring system may also receive data such as door open or closed status, ambient temperature, or time of day. Although the description herein refers to enclosure 112 temperature, embodiments may also monitor coolant temperature at an inlet or outlet of the compressor 104, coolant pressure at an inlet and outlet of the compressor 104, electrical power or current consumed by the compressor 104, ambient temperature, door status of an access door located in the enclosure 112. The modeling and detection described herein can also be applied to coolant temperatures, and coolant pressures, and compressor power or current consumption to detect pending system failures.

In an exemplary embodiment, the monitoring system 102 monitors the temperature inside the enclosure 112 using a temperature sensor 118. In such an exemplary embodiment, the monitoring system learns the temperature characteristics of the enclosure 112 in response to conditions such as compressor activity, door open or close activity, ambient temperature, etc. The monitoring system 102 may learn the typical temperature cycle (a lowering or raising of a monitored temperature during normal operation of the compressor).

Figure 3:
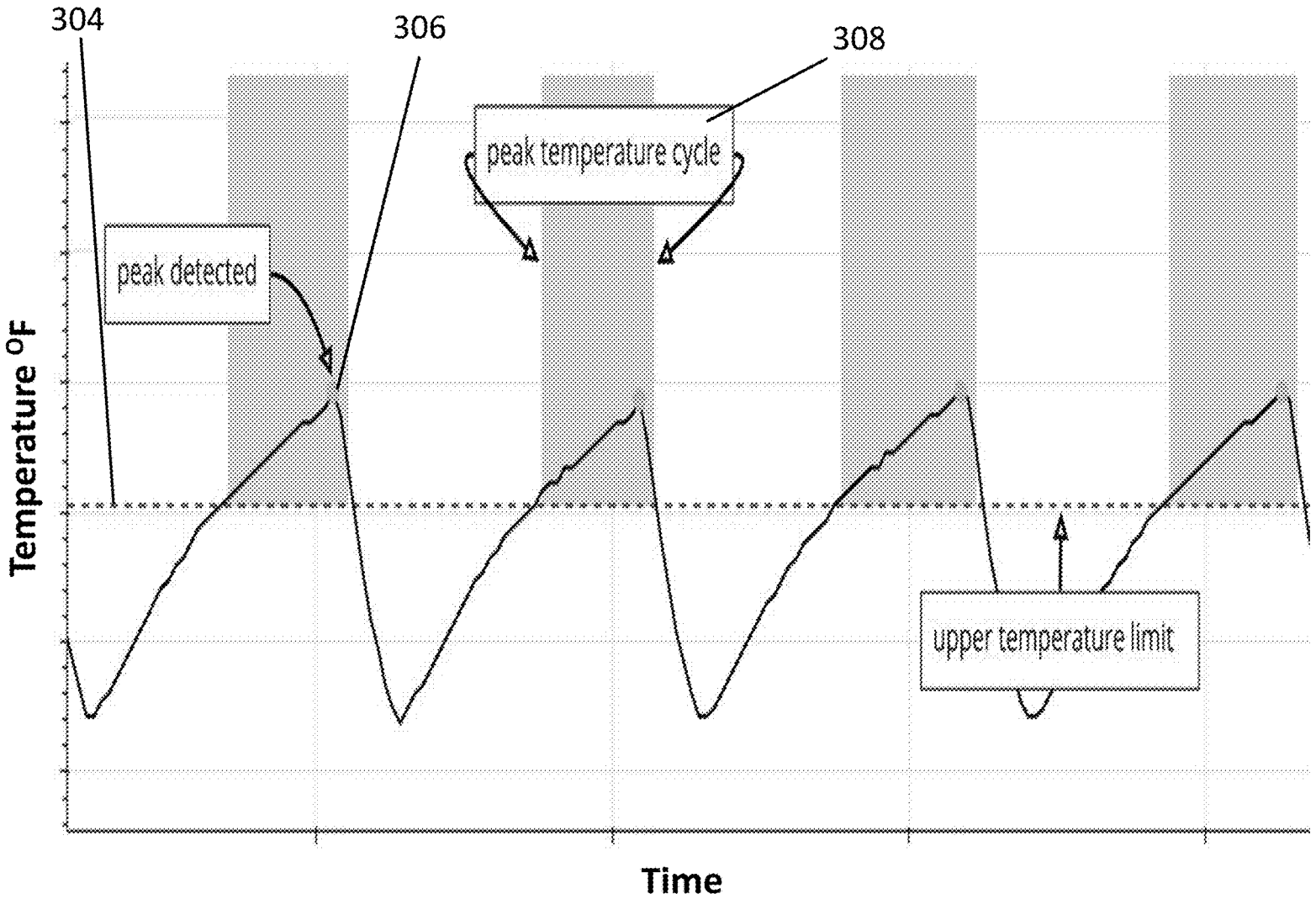
FIG. 3 illustrates a diagram showing a cooling system temperature over time as monitored by a monitoring system according to an exemplary embodiment.

In certain exemplary embodiments, peak detection is used to identify local maximum (peak) temperatures that exceed the upper temperature limit by a comparison of neighboring temperature values. As is shown in the graph of temperature over time 300 of FIG. 3, the temperature inside an enclosure 112 varies over time. As the temperature inside the enclosure 112 increases as shown by the upward slope at 302, a threshold is crossed. This causes a thermostatic temperature controller (not shown) to signal the compressor 104 to start. In the exemplary embodiment shown in FIG. 3, this temperature level is illustrated as the upper threshold 304 however, in certain other exemplary embodiments, the upper threshold 304 discussed herein may not be the temperature level that is used to control the temperature at which the compressor 104 begins to run. As the compressor 104 runs, the cooling system 100 begins to provide cooling at the first heat exchanger 106. As this cooling is introduced to the enclosure 112, the temperature detected by the temperature sensor 118 stops climbing, reaches a peak value 306, and begins to decline. In an exemplary embodiment, the period of time that the temperature inside the enclosure 112 exceeds the upper threshold 304 is referred to as a peak temperature cycle 308. Once the temperature peaks are detected, peak temperature cycles are determined by the monitoring system 102.

As is illustrated, peak temperature cycles are the durations during which a cooler's temperature remains above upper threshold 304. Many cooling systems 100 utilize heating systems or other methods to remove ice that may accumulate on the first heat exchanger 106. During the process of removing accumulated ice (often referred to as a "defrost cycle"), a heater located proximally to the heat exchanger 106 is energized while the compressor is held in an off state. This causes a micro-climate at the heat exchanger in which the temperature is high enough to cause the accumulated ice to melt from the heat exchanger. Because the compressor is not engaged and heat is introduced into the enclosure 112, higher than expected peak values 306 or longer than expected peak temperature cycles 308 may occur during a normal defrost cycle. However, similar peak values 306 or longer than expected peak temperature cycles 308 may also occur during abnormal circumstances such as a cooler door being accidentally left open, or a compressor 104 or control failure. As a result, certain exemplary embodiments may also monitor compressor 104 activity or door sensors (not shown).

Figure 4:
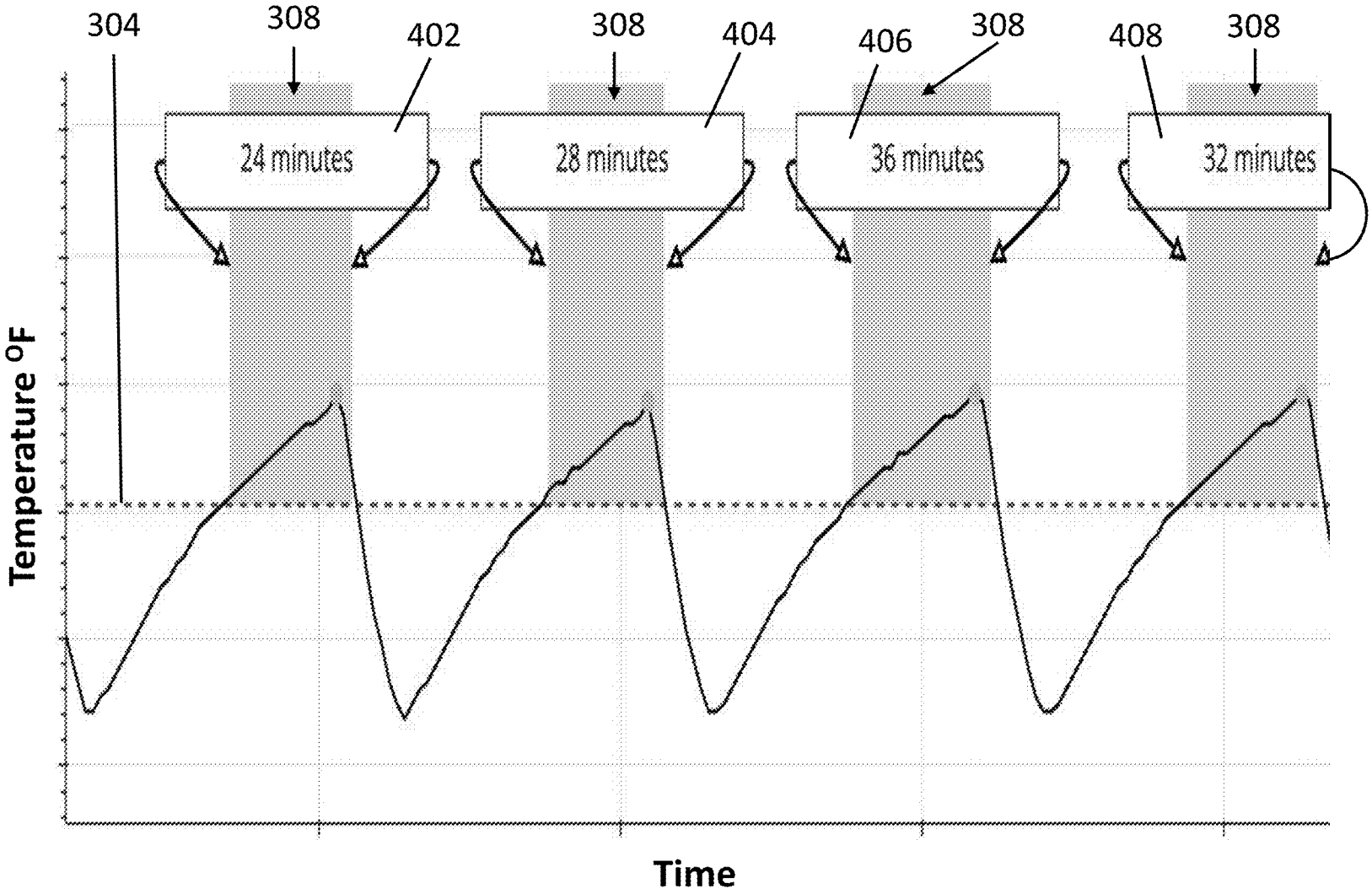
FIG. 4 illustrates a diagram showing a cooling system temperature over time as monitored by a monitoring system according to an exemplary embodiment.

An exemplary embodiment uses peak detection as well as temperature measurements over time to learn the normal duration of a cooling system's 100 peak temperature cycle 308. Thus, the monitoring system 102 "learns" what is normal with regard to the amount of time a cooling system's 100 temperature remains above its upper threshold 304 (the peak temperature cycle 308). This time duration is used to derive a normal or ordinary amount of time that a cooler's temperature will exceed the upper threshold 304. The monitoring system 102 uses this normal or ordinary amount of time to set an alert that is delivered to a user when the cooler temperatures exceed the set point for a duration longer than the normal or ordinary time. In an exemplary embodiment, the time that exceeds what has been determined to be normal or ordinary can be combined with other temperature cycle characteristics to determine the likely severity of the problem or failure which gave rise to the alert. An example of this is illustrated in FIG. 4. As shown, the peak temperature cycles 308 vary over time. In the illustrated example, the first time period 402 is 24 minutes, the second time period 404 is 28 minutes, the third time period 406 is 36 minutes, and the fourth time period 408 is 32 minutes. These durations are compared to other parameters such as, but without limitation, ambient air temperature and cooler door activity.

In addition to the peak temperature cycle 308, peak detection allows an exemplary embodiment to characterize the behavior of a cooling system 100 to enable predictive analytics. For example, an exemplary embodiment may detect and monitor the maximum temperature 306 a cooling system 100 ordinarily reaches during its peak temperature cycles 308, the number of peak temperature cycles 308 that usually occur during a time period, the normal amount of time between peak temperature cycles 308, or the slope or other characteristics of temperature rise or fall. For example, a steeper slope of temperature rise may indicate that a door to a cooling system has been left ajar, a less steep slope during temperature fall might indicate that there is a pending failure of the compressor 104 or other cooling system 100 component.

Figure 5:
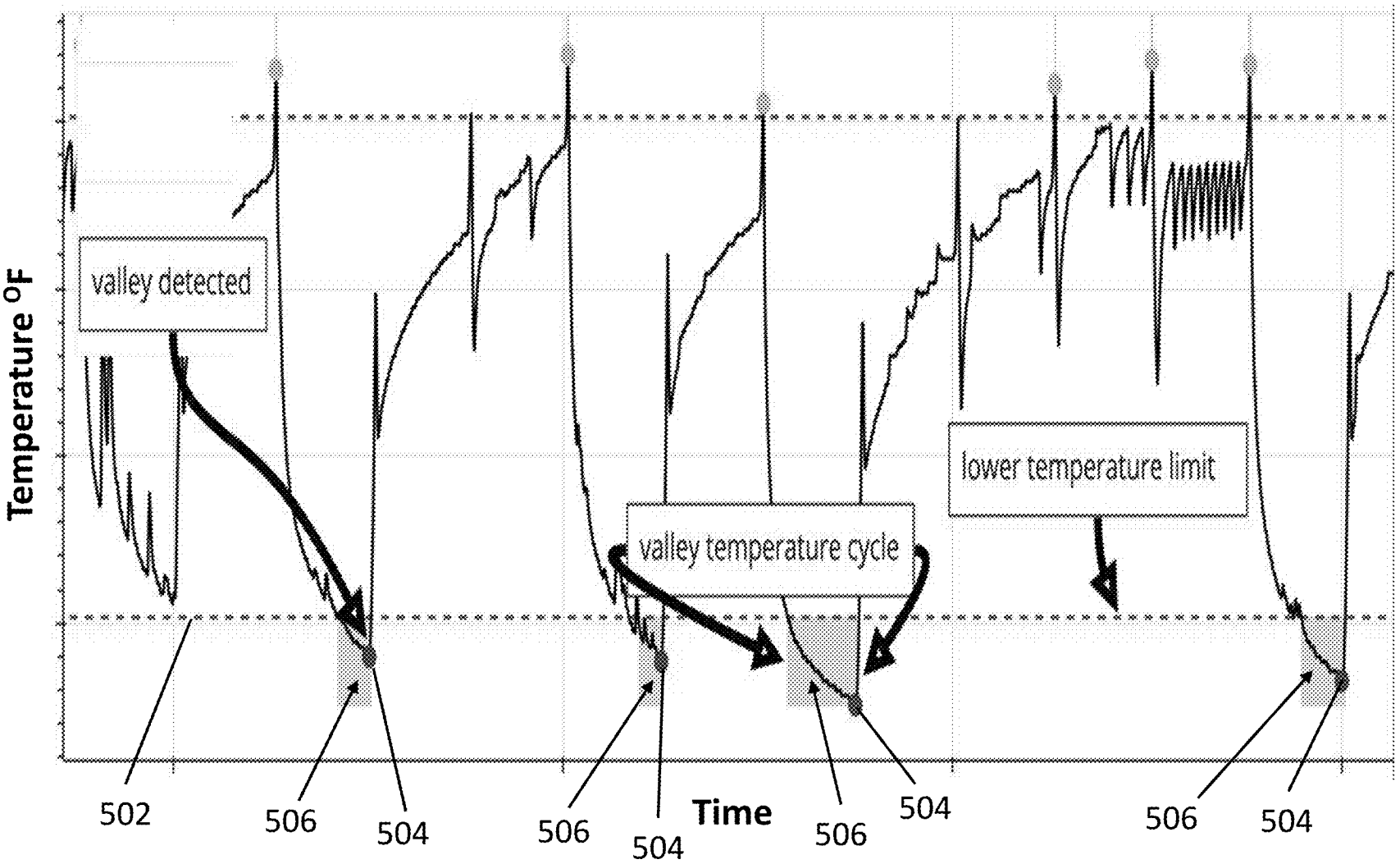
FIG. 5 illustrates a diagram showing a cooling system temperature over time as monitored by a monitoring system according to an exemplary embodiment.

Certain exemplary embodiments utilize a valley detection or time below lower temperature limit analysis. An example of this is illustrated in FIG. 5. This analysis uses an inverted peak or minimum value detection to learn the normal duration that a cooling system's 100 temperature remains below a lower temperature threshold 502. As is illustrated in the graph of FIG. 5, a series of inverted peak values 504 are determined by a monitoring system 102 in an exemplary embodiment. Valley detection is used identify temperatures that fall below the lower temperature threshold. An inverted peak is determined by a comparison of neighboring temperature values. Once a lowest temperature over a period of time is detected, an analysis of stored data is undertaken to identify a valley temperature cycle 506. Similar to peak temperature cycles 308, valley temperature cycles 506 are determined by the time that a temperature remains below a lower temperature threshold 502.

After peak temperature cycle 308 and valley temperature cycle 506 durations have been calculated by an exemplary embodiment, an Empirical Cumulative Distribution Function (ECDF) is calculated for each temperature cycle type. An ECDf is calculated for peak temperature cycle 308 durations and for valley temperature cycle 506 durations. In an exemplary embodiment, ECDFs are used to estimate the probability of a cooler behaving a certain way based on its historical behavior.

Figure 6:
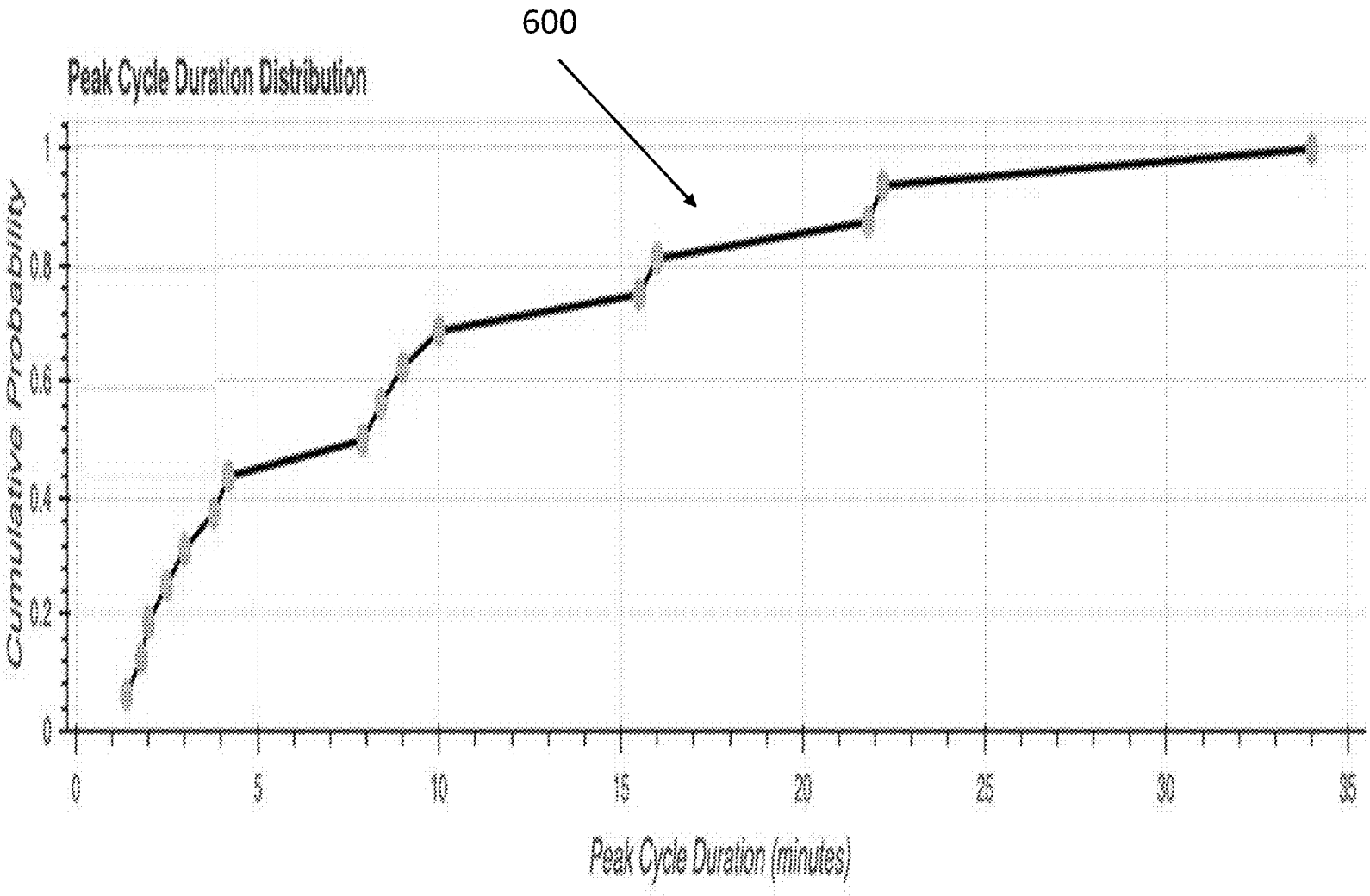
FIG. 6 illustrates a chart of cooling temperature cycle times as analyzed by an exemplary embodiment.

For the above example, an ECDF allows us to estimate the probability of a cooler's peak temperature cycle lasting a specific duration or less based on historical observations. As is shown in the peak cycle duration distribution graph 600 of FIG. 6, each peak temperature cycle duration 308 of the sample is sorted in ascending order across the x-axis. The y-axis shows the cumulative probability of each duration which ultimately adds up to 1. For example, in an exemplary embodiment, a series of peak temperatures is collected. A duration of each peak is calculated and a distribution of peak levels is determined. In the exemplary embodiment, a threshold is established at 90% and an alert generated when a peak duration exceeds a duration equivalent to the established threshold value.

In an exemplary embodiment, alerting time selection is buffered to limit unnecessary alerts. For example, data from a cooling system 100 has been collected by a monitoring system 102. The data has been analyzed and it has been determined that the cooling system 100 has several consistent peak temperature cycle durations, all between 15-20 minutes each. In this example, selecting an upper time limit threshold of 20 minutes would most likely result in nuisance alerts to a user because a peak temperature cycle duration lasting 21 minutes would send an alert when in reality, there may be no cause for alarm. In order to address such nuisance alerts, a time selection buffer can be employed. Based on the sample size of the observations, a time buffer is applied to the alerting time limit selected. In an exemplary embodiment, large sample sizes will have a smaller time buffer (i.e., 10 minutes) while smaller sample sizes will have a larger time buffer (i.e., 30 minutes). The larger time buffer is required due to a lower level of certainty provided by small sample sized.

Exemplary embodiments employ historical data to predict what incidents are abnormal for a cooling system. In order to avoid using abnormal data to establish what is "normal" for a cooling system, a method of distinguishing between normal and abnormal observations is needed. For example, when learning what is normal for peak temperature cycle durations, it would be undesirable to set an upper time limit too high as the result of an event during which the cooler's peak temperature cycle duration was actually abnormally high. In order to distinguish between what is normal and abnormal, Median Absolute Deviation (MAD) is used as a measure to identify outliers in a cooling system's historical data. MAD is used in certain exemplary embodiments due to its ability to adjust to various sample sizes (i.e., some cooling systems may not have a sample size that comprises a sufficient number of data samples to properly learn from) and varying data distributions. The ability to adjust to different data distributions is critical because research has indicated that not all cooling systems exhibit cycle duration data that follows a common distribution pattern.

Figure 7:
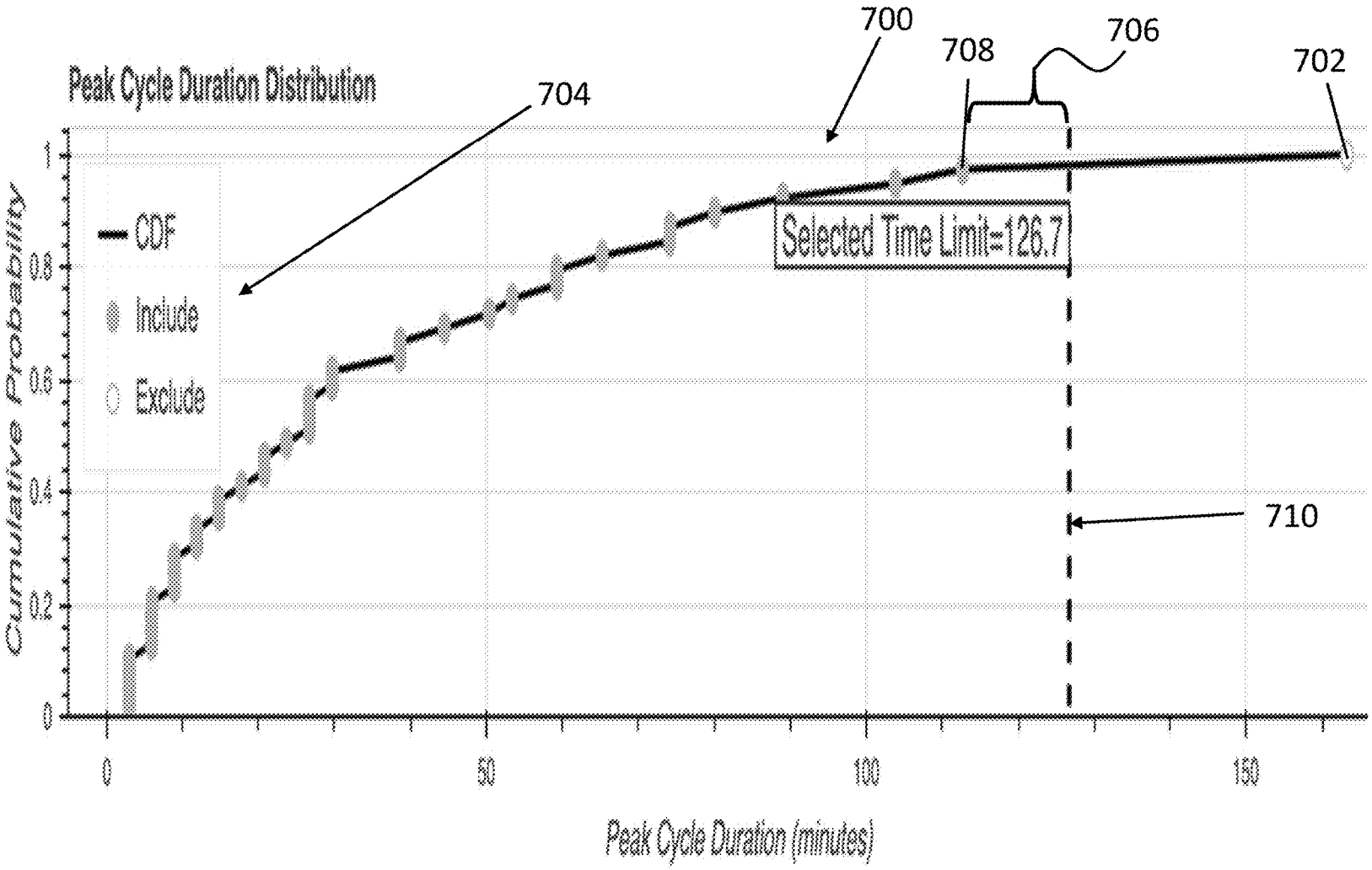
FIG. 7 illustrates a chart of cooling temperature cycle times as analyzed by an exemplary embodiment.

The FIG. 7 shows a graph 700 which illustrates an example ECDF with an outlier 702 detected via MAD. The outlier 702 is labeled "Exclude" as shown in the chart legend 704. In an exemplary embodiment, the detected outlier 702 (i.e., the rightmost observation) is ignored when calculating an upper time limit. The graph 700 also shows an example of applying a time buffer. This is illustrated by the spacing 706 between the rightmost non-outlier observation 708 and the black dotted vertical line 710 which represents a selected time limit. As a safety net for time limit selection, a priori information will be used in an exemplary embodiment to set time bounds. This ensures the learned upper time limit and lower time limit will always be selected between a minimum and maximum range as determined by the time bounds to guard against unrealistic and unhelpful time selections.

In an exemplary implementation, critical failures of a cooling system used for refrigeration of perishable food items must generally be addressed within four hours of the failure to prevent damage to the contents of the refrigerator. Therefore, in such an exemplary implementation, an upper boundary of three hours for a time limit selection is used to ensure that a monitoring system according to an exemplary embodiment provides a warning to users that alerts them to a detected or predicted failure before this four-hour period elapses. In order to determine a selection of lower time boundaries, testing of an exemplary embodiment was initiated with a one-hour lower time limit. Initial observations revealed that normally operating cooling systems used in refrigerators generally have peak temperature cycle durations of around 30-45 minutes. In light of these observations, a lower time boundary of 60 minutes was chosen to provide a small buffer of time between an elapsed time that would generate an alert and the normal time periods observed during testing.

In some exemplary embodiments, the processor 202 of a monitoring system 102 may be configured to learn how a particular cooling system behaves in order to narrow the range of peak cycle durations that should be considered as indicative of an actual or pending failure. As more data is received and analyzed, certain exemplary embodiments will continue to refine the time boundary limits in order to alert users as quickly as possible while avoiding false failure indications.

In certain exemplary embodiments, data collected by the monitoring system 102 can be provided to a monitored data analysis system 120 (see FIG. 1). In certain exemplary embodiments, this monitored data analysis system 120 is integrated into the monitoring system 102 while in other exemplary embodiments, the monitored data analysis system 120 can be located remotely from the monitoring system 102. By utilizing the communications portion 208 of the monitoring system 102, the monitored data analysis system 120 can be located at a completely different geographic location than that of the cooling system 100 which comprises the monitoring system 102. In certain exemplary embodiments, the monitored data analysis system 120 can perform a process that at regular intervals, learns the upper time limit and the lower time limit of a plurality of cooling systems. In an exemplary embodiment and installation, refrigeration units classified as standard coolers or freezers will be learning coolers and used to refine the upper time limit and lower time limits while other coolers and freezers that perform more critical roles (for example, without limitation, pharmacy coolers and freezers) will be non-learning coolers and thus not be used to adjust the upper time limit and the lower time limit thresholds used for alerting users. In certain exemplary embodiments, the selection of which coolers or freezer identified as performing critical cooling roles may be selected by a user.

Having now described some illustrative implementations, it is apparent that the foregoing is illustrative and not limiting, having been presented by way of example. In particular, although many of the examples presented herein involve specific combinations of method acts or system elements, those acts and those elements can be combined in other ways to accomplish the same objectives. Acts, elements, and features discussed in connection with one implementation are not intended to be excluded from a similar role in other implementations.

The hardware and data processing components described in FIGS. 1 and 2 as well as referred to elsewhere herein as being used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some exemplary embodiments, particular processes and methods may be performed by circuitry that is specific to a given function. The memory (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit and/or the processor) the one or more processes described herein.

The present disclosure contemplates methods, systems and program products on any machine-readable media for accomplishing various operations. The exemplary embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

The phraseology and terminology used herein is for the purpose of description and should not be regarded as limiting. The use of "including" "comprising" "having" "containing" "involving" "characterized by" "characterized in that" and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

Any references to implementations or elements or acts of the systems and methods herein referred to in the singular can also embrace implementations including a plurality of these elements, and any references in plural to any implementation or element or act herein can also embrace implementations including only a single element. References in the singular or plural form are not intended to limit the presently disclosed systems or methods, their components, acts, or elements to single or plural configurations. References to any act or element being based on any information, act or element can include implementations where the act or element is based at least in part on any information, act, or element.

Any implementation or embodiment disclosed herein can be combined with any other implementation or embodiment, and references to "an implementation," "some implementations," "one implementation," "an embodiment," "some embodiments," "certain embodiments," or the like are not necessarily mutually exclusive and are intended to indicate that a particular feature, structure, or characteristic described in connection with the implementation can be included in at least one implementation or embodiment. Such terms as used herein are not necessarily all referring to the same implementation. Any implementation or embodiment can be combined with any other implementation or embodiment, inclusively or exclusively, in any manner consistent with the aspects and implementations disclosed herein.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

Systems and methods described herein may be embodied in other specific forms without departing from the characteristics thereof.

References to "or" can be construed as inclusive so that any terms described using "or" can indicate any of a single, more than one, and all of the described terms. A reference to "at least one of 'A' and 'B'" can include only 'A', only 'B', as well as both 'A' and 'B'. Such references used in conjunction with "comprising" or other open terminology can include additional items.

Modifications of described elements and acts such as variations in sizes, dimensions, structures, shapes and proportions of the various elements, values of parameters, mounting arrangements, use of materials, colors, orientations can occur without materially departing from the teachings and advantages of the subject matter disclosed herein. For example, elements shown as integrally formed can be constructed of multiple parts or elements, the position of elements can be reversed or otherwise varied, and the nature or number of discrete elements or positions can be altered or varied. Other substitutions, modifications, changes and omissions can also be made in the design, operating conditions and arrangement of the disclosed elements and operations without departing from the scope of the present disclosure.

References herein to the positions of elements (e.g., "top," "bottom," "above," "below") are merely used to describe the orientation of various elements in the Figures. The orientation of various elements may differ according to other exemplary embodiments, and that such variations are intended to be encompassed by the present disclosure.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

What is claimed is:

1. A system for monitoring a cooling system comprising:
a processor;
a memory;
a sensor associated with the cooling system; and
an alert transmission device;
the memory comprising instructions that when executed by the processor, cause the processor to:
receive a plurality of data points from the sensor over a first period of time;
determine a plurality of peak cycles where data points are above a predetermined threshold;
determine a peak value measured during each of the plurality of peak cycles;
calculate an empirical cumulative distribution function for the calculated peak cycles;
sort the peak cycle in ascending time order and establish a maximum threshold as a percentage of the cumulative probability of peak cycle times;
generate an alert indicating a potential failure of the cooling system when the cumulative probability of a peak cycle time exceeds a predetermined period of time; and
transmit the alert using the alert transmission device.

2. The system of claim 1, wherein the sensor is a temperature sensor.

3. The system of claim 1, wherein the sensor is a pressure sensor.

4. The system of claim 1, wherein the sensor is current sensor measuring the current drawn by a compressor used in the cooling system.

5. The system of claim 1, wherein the divergence is a maximum sensor measurement.

6. The system of claim 1, wherein the divergence is a minimum sensor measurement.

7. The system of claim 1, wherein the divergence is one of a frequency of maximum sensor measurement occurrences or a frequency of minimum sensor measurement occurrences.

8. The system of claim 1, wherein the divergence is a length of time between a maximum temperature and a minimum sensor measurement.

9. The system of claim 1, wherein the divergence is a length of time between a maximum sensor measurement and a minimum sensor measurement.

10. The system of claim 1, wherein the divergence is a variation in a length of time between a maximum sensor measurement and a minimum sensor measurement.

11. The system of claim 1, further comprising a door status monitor and the instructions further cause the processor to receive a door status condition from the door status monitor and generate the baseline considering the door status.

12. The system of claim 1, further comprising instructions that cause the processor to monitor compressor activity and generate the baseline considering the compressor activity.

13. The system of claim 1, further comprising instructions that when executed by the processor, cause the processor to:

determine of a plurality of minimum cycles where data points are below a predetermined threshold;

determine a minimum value measured during each of the plurality of minimum cycles;

calculate an empirical cumulative distribution function for the calculated minimum cycles;

sort the minimum cycles in ascending time order and establish a maximum threshold as a percentage of the cumulative probability of minimum cycle times;

generate an alert indicating a potential failure of the cooling system when the cumulative probability of a minimum cycle time exceeds a predetermined period of time; and transmit the alert using the alert transmission device.

14. A method of monitoring a cooling system comprising:

receiving a plurality of data points from a sensor over a period of time;

determine a plurality of peak cycles where data points are above a predetermined threshold;

determine a peak value measured during each of the plurality of peak cycles;

calculate an empirical cumulative distribution function for the calculated peak cycles;

sort the peak cycle in ascending time order and establish a maximum threshold as a percentage of the cumulative probability of peak cycle times;

generating an alert indicating a potential failure of the cooling system when the cumulative probability of a peak cycle time exceeds a predetermined period of time; and transmitting the alert to an alert reporting system.

15. The method of claim 14, wherein the sensor is a temperature sensor.

16. The method of claim 14, wherein the divergence is one of a maximum or a minimum sensor measurement.

17. The method of claim 14, wherein the divergence is a frequency of maximum sensor measurement occurrences.

18. The method of claim 14, wherein the divergence is a frequency of minimum sensor measurement occurrences.

19. The method of claim 14, wherein the divergence is a length of time between a maximum sensor measurement and a minimum sensor measurement.

20. The method of claim 14, wherein the divergence is a variation in a length of time between a maximum sensor measurement and a minimum sensor measurement.

21. A system for monitoring a cooling system comprising:

a processor;

a memory;

a temperatures sensor associated with the cooling system;

a door position sensor; and an alert transmission device;

the memory comprising instructions that when executed by the processor, cause the processor to:

receive a first plurality of data points from the sensor over a first period of time;

determine a normal duration of peak temperature cycles found in the first plurality of data points from the sensor;

receive a second plurality of data points from the sensor over a second period of time;

identify at least one peak temperature cycle in the second plurality of data points, compare the least one peak temperature cycle in the second plurality of data points with the determined normal duration of the peak temperature cycles to identify a divergence from the normal duration of the peak temperature cycles;

determine if a defrost cycle occurred during the second plurality of data points;

if no defrost cycle occurred during the second plurality of data points, generate an alert indicating a potential failure of the cooling system; and transmit the alert using the alert transmission device.

22. The method of claim 14, further comprising the steps of:

determining of a plurality of minimum cycles where data points are below a predetermined threshold;

determining a minimum value measured during each of the plurality of minimum cycles;

calculating an empirical cumulative distribution function for the calculated minimum cycles; and sorting the minimum cycles in ascending time order and establish a maximum threshold as a percentage of the cumulative probability of minimum cycle times.

23. The method of claim 22, further comprising the steps of:

generating an alert indicating a potential failure of the cooling system when the cumulative probability of a minimum cycle time exceeds a predetermined period of time; and transmitting the alert using the alert transmission device.

* * * * *